US008146671B2

(12) United States Patent
Sipos

(10) Patent No.: US 8,146,671 B2
(45) Date of Patent: Apr. 3, 2012

(54) SHOULDER-TYPE ELEVATOR AND METHOD OF USE

(76) Inventor: David Sipos, Lafayette, LA (US)

( * ) Notice: Subject to any disclaimer, the term of this patent is extended or adjusted under 35 U.S.C. 154(b) by 379 days.

(21) Appl. No.: 12/367,347

(22) Filed: Feb. 6, 2009

(65) Prior Publication Data

US 2010/0200221 A1 Aug. 12, 2010

(51) Int. Cl.
*E21B 19/07* (2006.01)

(52) U.S. Cl. ..... 166/380; 166/77.52; 166/77.1

(58) Field of Classification Search ..... 166/379, 166/380, 77.51, 77.52, 77.14, 77.1; 294/102.2; 175/423

See application file for complete search history.

(56) References Cited

U.S. PATENT DOCUMENTS

| | | | | |
|---|---|---|---|---|
| 1,966,454 | A * | 7/1934 | Moody | 188/67 |
| 2,065,130 | A | 12/1936 | Grau | |
| 2,237,856 | A | 4/1941 | Wilson | |
| 6,237,684 | B1 | 5/2001 | Bouligny, Jr. et al. | |
| 6,568,479 | B2 | 5/2003 | Sipos et al. | |
| 6,637,526 | B2 | 10/2003 | Juhasz et al. | |
| 6,679,333 | B2 | 1/2004 | York et al. | |

* cited by examiner

*Primary Examiner* — David Andrews

(57) ABSTRACT

A pipe elevator comprised of a frame pivotally mounted on elongated hangers and having a body with an inward tapered opening that is configured to receive a length of pipe having an outwardly protruding collar around its periphery. A plurality of shoes is mounted within the body. The shoes are poweredly positionable upward and downward within the inward tapered opening of the body and thereby positionable radially inward and outward around the pipe. A means for biasing the shoes upward is provided whereby the weight of the pipe against the shoes will move the shoes around the pipe collar against the periphery of the pipe.

21 Claims, 10 Drawing Sheets

SHOULDER-TYPE ELEVATOR AND METHOD OF USE

FIELD OF INVENTION

This invention generally relates to oil well casing handling devices typically referred to as elevators. More particularly, it relates to an improved shoe type, shoulder elevator.

BACKGROUND

In order to lower and raise long strings of pipe, such as well casing, into a well bore, an elevator and a spider are typically arranged in alignment with an opening in the rotary table on the working platform of an oil well derrick. The spider is mounted within or on the working platform and is used to grip and release a string of tubulars such as pipe or casing as the tubulars are suspended in the well bore. The elevator is suspended above the spider by hangers and bails that are attached to a hoist mounted on the rig derrick. The elevator is used to grip, lift, and release a string of tubulars in cooperation with the spider to add pipe to the tubular string and to lower and raise the tubular string into and out of the well bore. A length or joint of pipe or casing has a threaded connection at each end. These pipe segments have internally threaded bands called collars that extend outward around the periphery of at least one end of each of these pipe segments. Long strings of pipe or casing are connected together by threaded connections at these collars for installation into a well bore. The annulus surface at the base of the collar between the outer periphery of the collar and the periphery of pipe is called the shoulder of the collar. These strings of casing pipe may weight hundreds of tons. Such weight can put substantial stress, strain, and fatigue on the elevator and its components during its use. An elevator that supports a string of casing pipe on the shoulder of the collar is known as a shoulder-type elevator.

SUMMARY

A rotating shoulder-type elevator is described. The elevator has a frame, a pair of hanger pins, and a pair of support rods for suspending the elevator by the hanger pins on bails at the end of a hoist. The frame supports a ring shaped body which has a plurality of movable shoes. The shoes travel up and down along a short taper within the interior of the body ring in response to movement of a timing ring positioned above the body. An array of pins and link assemblies pivotally connect the timing ring to the movable shoes. T-slots or other types of machine slides may be provided on the tapered interior surface of the body ring and the body ring side surface of the shoes in order to guide the movement of the shoes within the body ring. The timing ring, the movable shoes, and the pins and link assemblies provide a shoe assembly that is actuated by remotely controlled hydraulic cylinders attached to the body ring and the timing ring.

Remotely operated hydraulic cylinders are mounted to the elevator frame and each support rod in order to rotate the frame and the elevator body ring about the axis of the hanger pins by extension and retraction of the hydraulic cylinder rods. These cylinders allow the elevator to be rotated on the hanger pins to axially receive an incoming joint of pipe within the body ring whether the pipe joint is presented on a skate or on slings through the "Vee Door" of a rig derrick. After the pipe enters the elevator body ring, the shoes are lowered by manipulation of the timing ring, and the elevator may be rotated on the hanger pins by extension of the support rod cylinders to return the elevator to its upright position as the pipe is lifted.

The elevator is intended for use with pipe having shouldered connection collars. The shoe assembly is designed to take-up the clearance between the pipe and the elevator body and to keep the pipe and pipe collar centralized within the body ring of the elevator. In operation, the timing ring and thus the movable shoes are lowered by the hydraulic cylinders to a point where the timing ring contacts compression springs placed around the cylinder rods of the hydraulic cylinder. Downward powered movement of the timing ring and thus the shoes then ceases when the cylinders bottom out and the timing ring is then supported on the cylinder rod springs with the shoes in a position slightly up from their fully down position.

As the elevator is raised further, the pipe collar shoulder contacts the upper surface of the shoes and forces the shoes and timing ring down against the resistance of the rod springs until the shoes contact the circumference of the pipe body at point below the pipe collar. At that point, no further travel of the shoes is possible and no gap exists between the pipe surface and the elevator's shoes. The pipe and the collar are then surrounded and supported by the elevator's shoe assembly for virtually 360 degrees. In this manner, the elevator may be safely employed to support the pipe regardless of the bevel configuration of the pipe collar.

When the pipe joint has been stabbed into the top of a preceding pipe joint in the pipe string, the elevator may be lowered slightly to permit the shoes to move upward by action of the cylinder rod springs and slightly away from the pipe circumference to provide clearance between the elevator shoes and the pipe circumference. This movement allows the pipe joint to be rotated freely without drag during make-up with the pipe string. Because the shoes are still in position around and below the pipe collar during such rotation, the connection with the pipe string may be made while the pipe joint is still under control of the elevator. This will provide a safeguard from dropping or loosing the pipe during the make-up.

DRAWINGS

DESCRIPTION

Figure 12:
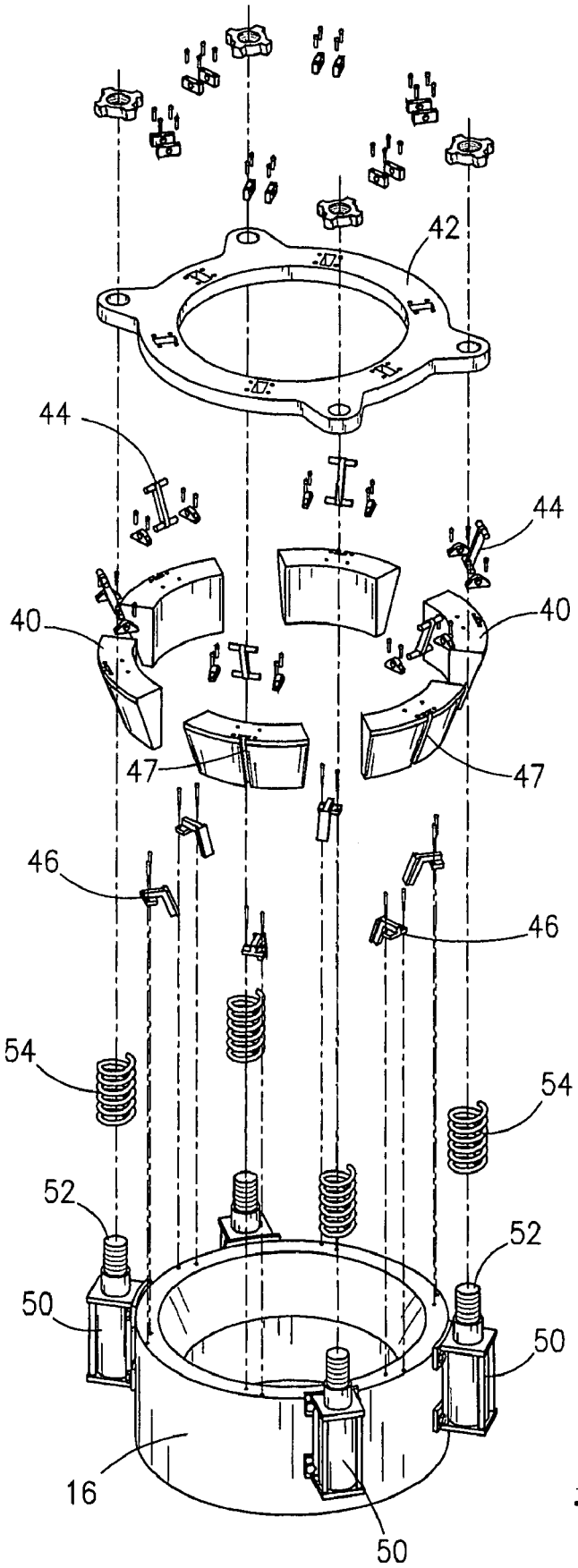
FIG. 12 is an exploded view of the components of the elevator of FIG. 1.

FIGS. 1 through 5 and exploded view FIG. 12, show an embodiment of the rotating shoulder-type elevator of Applicant's invention. The elevator (10) has a frame (12) comprised of a pair of vertically oriented frame plates (14). A ring-shaped elevator body (16), the interior of which is slightly tapered inward, is supported between the frame plates (14). A hanger pin (18) extends perpendicularly outward from the top of each of the frame plates (14). A vertically oriented hanger plate (20) extends between the hanger pins (18) and overhanging flange segments (22) that project from, and that are preferably integrally formed with, the body ring (16).

The hanger pins (18) allow the elevator to be pivotally on bails (24) at the end of hanger rods (26) that are attached to a hoist, not shown. The hanger plate (20) distributes the elevator loads to the body ring (16). For the sake of strength and safety, the frame plates (14), the body ring (16), the hanger pins (18), and the hanger plates (20) are preferably constructed of forged, alloy steel.

Figure 1:
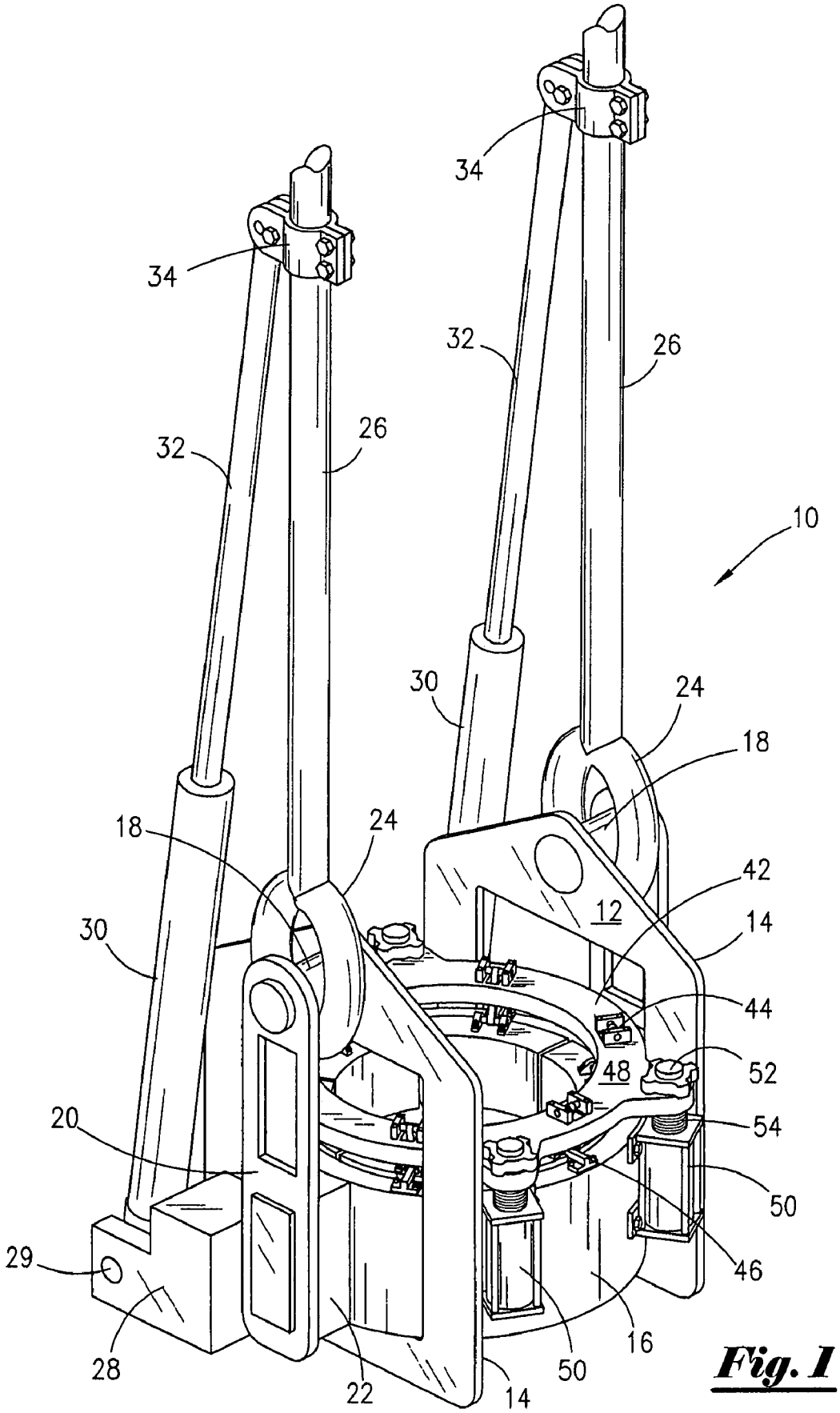
FIG. 1 is a perspective view of the elevator of the present invention.
Figure 2:
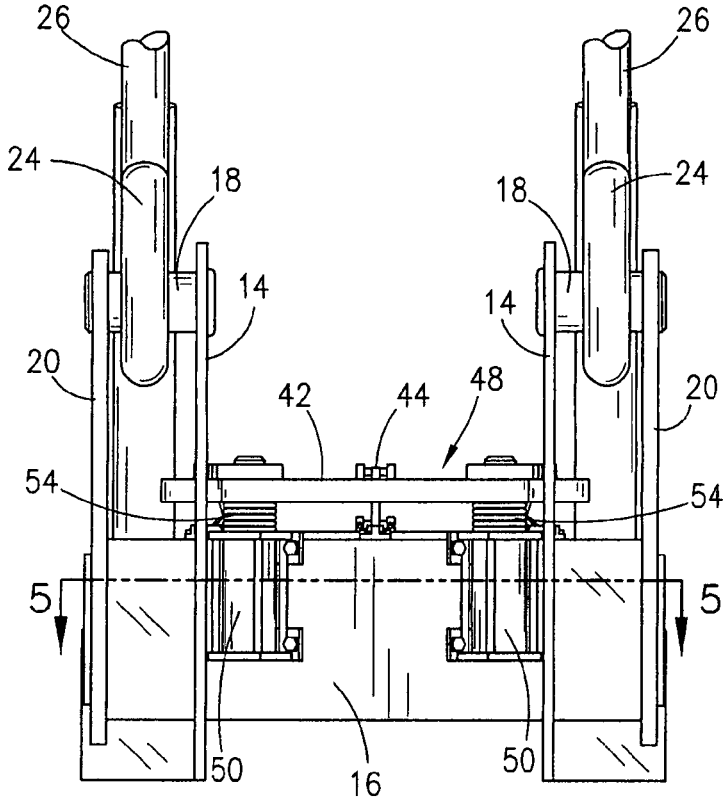
FIG. 2 is a partial front elevation view of the elevator of FIG. 1.
Figure 3:
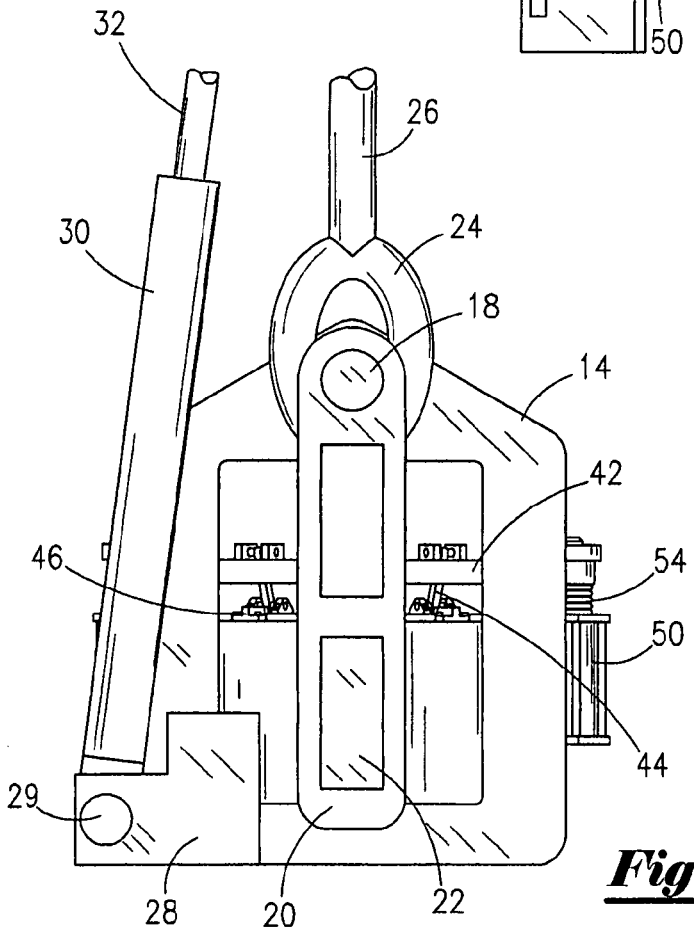
FIG. 3 is a partial side elevation view of the elevator of FIG. 1.
Figure 4:
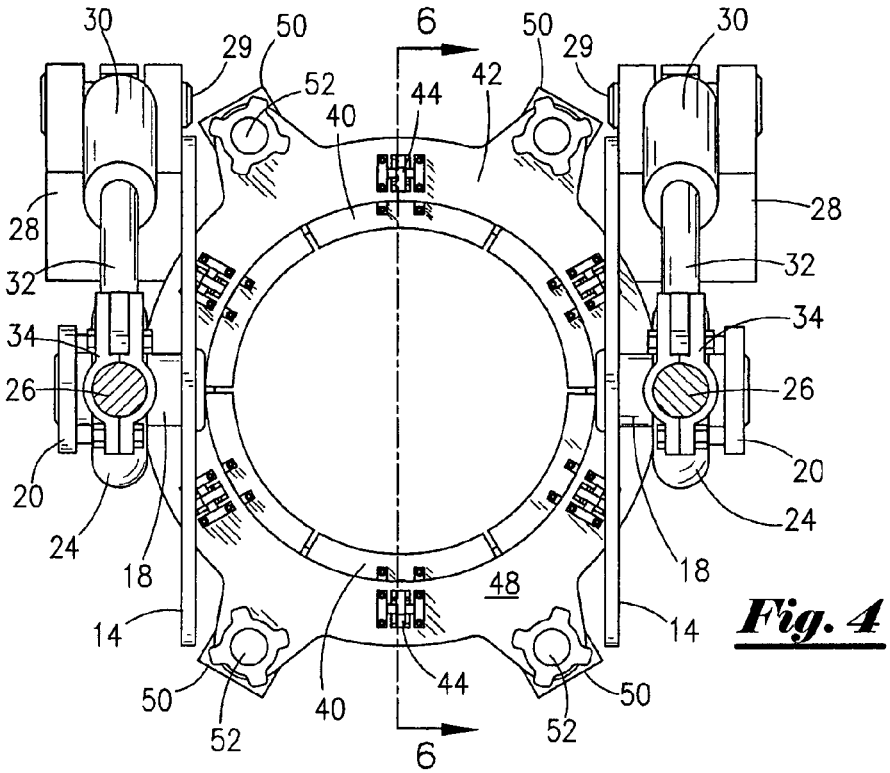
FIG. 4 is a top view of the elevator of FIG. 1.
Figure 5:
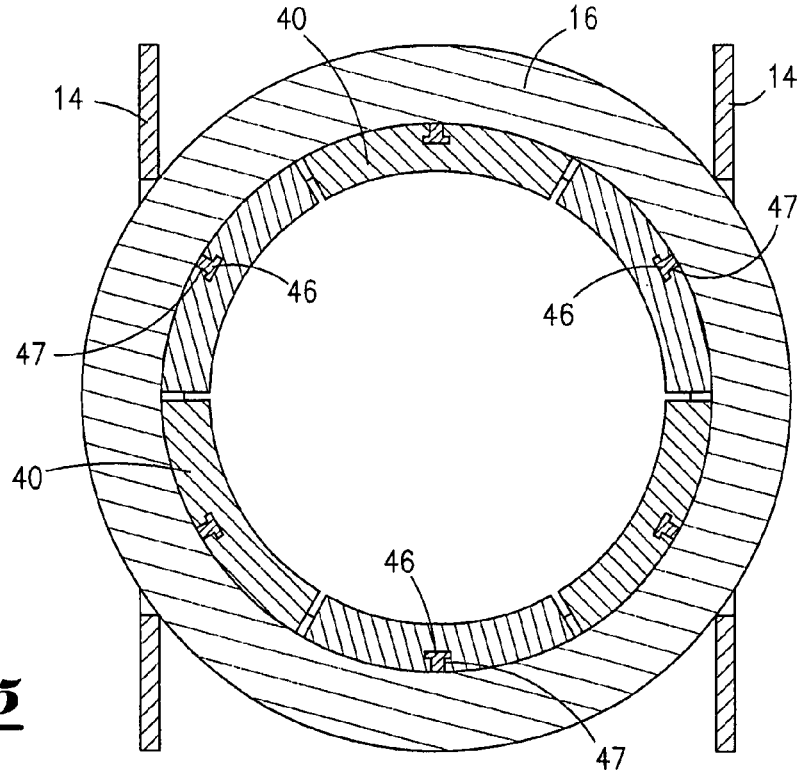
FIG. 5 is a top cross-sectional view of the elevator of FIG. 1.

As shown in FIG. 1 and FIG. 3, brackets (28) are mounted to the frame plates (14). Heavy duty hydraulic cylinders (30), each having piston rods (32), are pivotally attached to the brackets (28) by means of bracket pins (29). The piston rods (32) are in turn pivotally attached at their distal end to the hanger rods (26) by means of hanger rod clamps (34). The cylinders (30) may be remotely activated to extend and retract the piston rods (32) by hydraulic, pneumatic, or mechanical control lines, not shown, that extend to a remotely located control center, also not shown.

Figure 6:
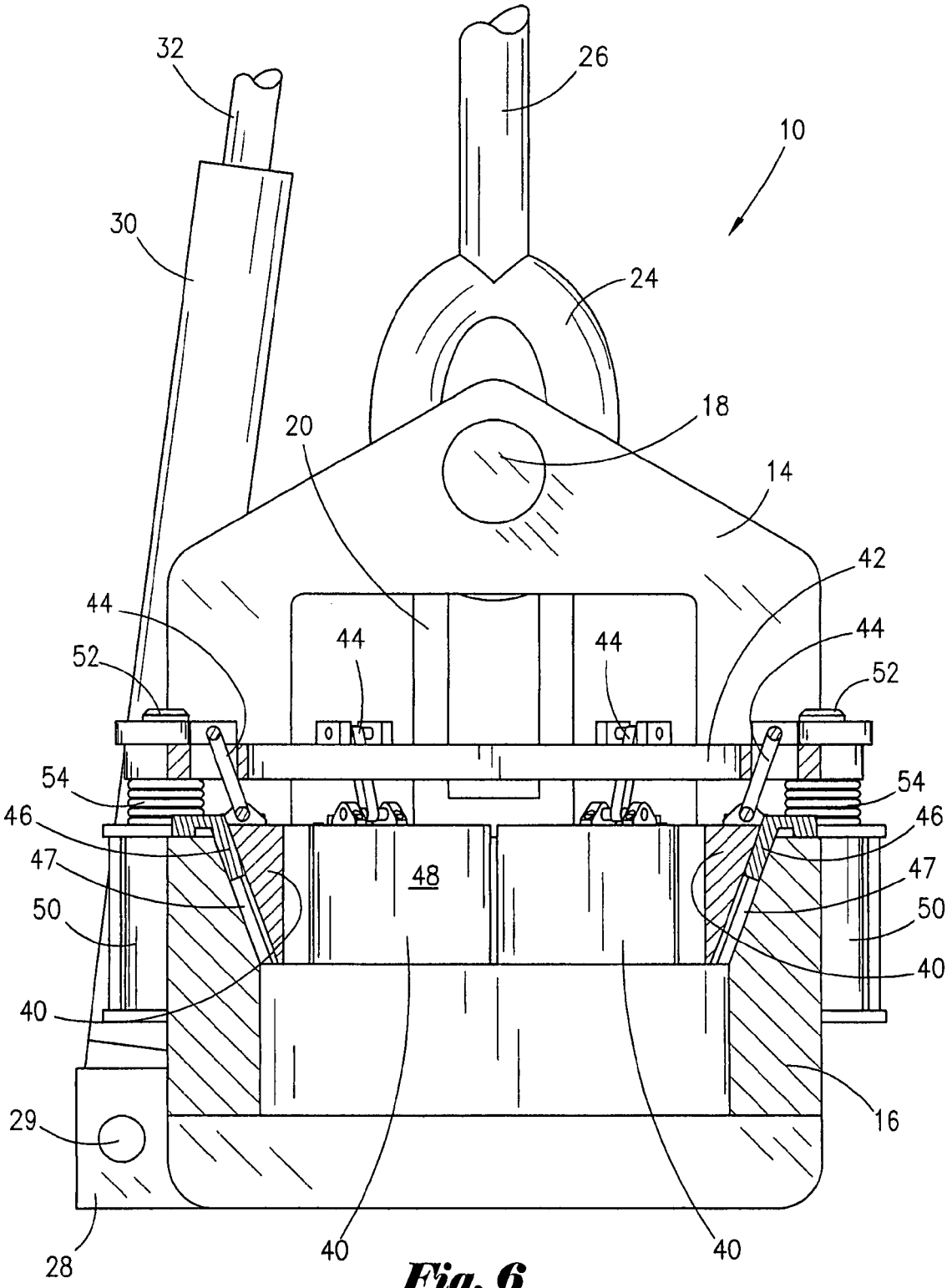
FIG. 6 is a side cross-sectional view of the elevator of FIG. 1 with the timing ring and shoes in a lowered position.

As shown in FIG. 6, a series of moveable shoes (40), pivotally attached to a timing ring (42) by an array of pin and link assemblies generally designated as (44) so that the movable shoes (40) are positioned within the central opening of the body ring (16). The array of shoes (40) forms a curvilinear ring around the interior of the body ring (16). The shoes (40) travel up and down along the interior of the body ring (16) which has a short inward taper so that the shoes (40) move radially inward and outward within the interior of the body ring (16) in response to upward and downward movement of the timing ring (42). Machine slides such as T's or keys (46) are provided on the tapered interior surface of the body ring (16) to interlock with T-slots or key slots (47) on the ring side surface of the shoes (40) to serve as a guide for movement of the shoes (40).

The timing ring (42), the movable shoes (40), and the pins and link assemblies (44) together provide a shoe assembly (48). The shoe assembly (48) is actuated for reciprocal upward and downward movement with respect the body ring (16) by a plurality of remotely controlled hydraulic cylinders (50) that are mounted on the exterior of the body ring (16). The cylinders (50) have a cylinder rod (52) that supports the timing ring (42) for reciprocal movement in response to actuation of the cylinders (50). Contact rod coil compression springs (54) are placed on the cylinder rods (52) below the timing ring (42) to restrict powered downward movement of the timing ring (42) and to bias the timing ring (42) and shoes (40) upward as the shoe assembly (48) moves downward in the body ring (16).

Other means to bias the timing ring (42) and shoes (40) upward as the shoe assembly (48) moves downward in the body ring (16) might be utilized. Examples of such other means to bias the timing ring (42) and shoes (40) upward include Belleville washers or disk springs stacked as necessary on the cylinder rods (52) or leaf springs or hydraulic shock springs mounted on the body ring (16) at a desired point for contact with the timing ring (42).

Control lines, not shown, that extend to a remotely located control center, also not shown, are used to remotely activate the cylinders (50) to extend and retract the piston rods (52). While hydraulic fluid cylinders are described, it is thought that the cylinders (50) could be hydraulically, pneumatically, or mechanically operated.

Figure 7:
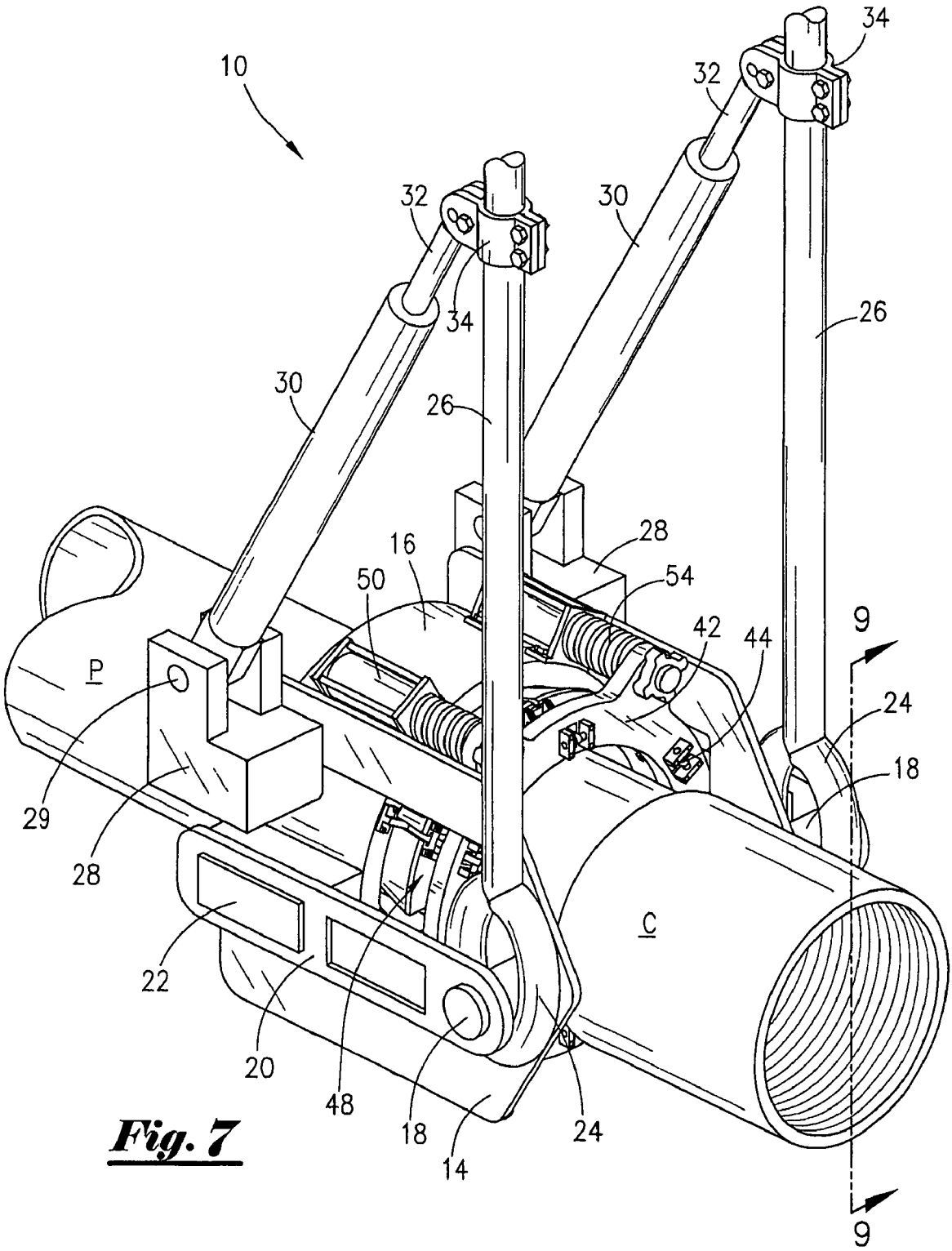
FIG. 7 is a perspective view of the elevator of the elevator of FIG. 1 with the elevator in a rotated position to receive a joint of pipe.
Figure 8:
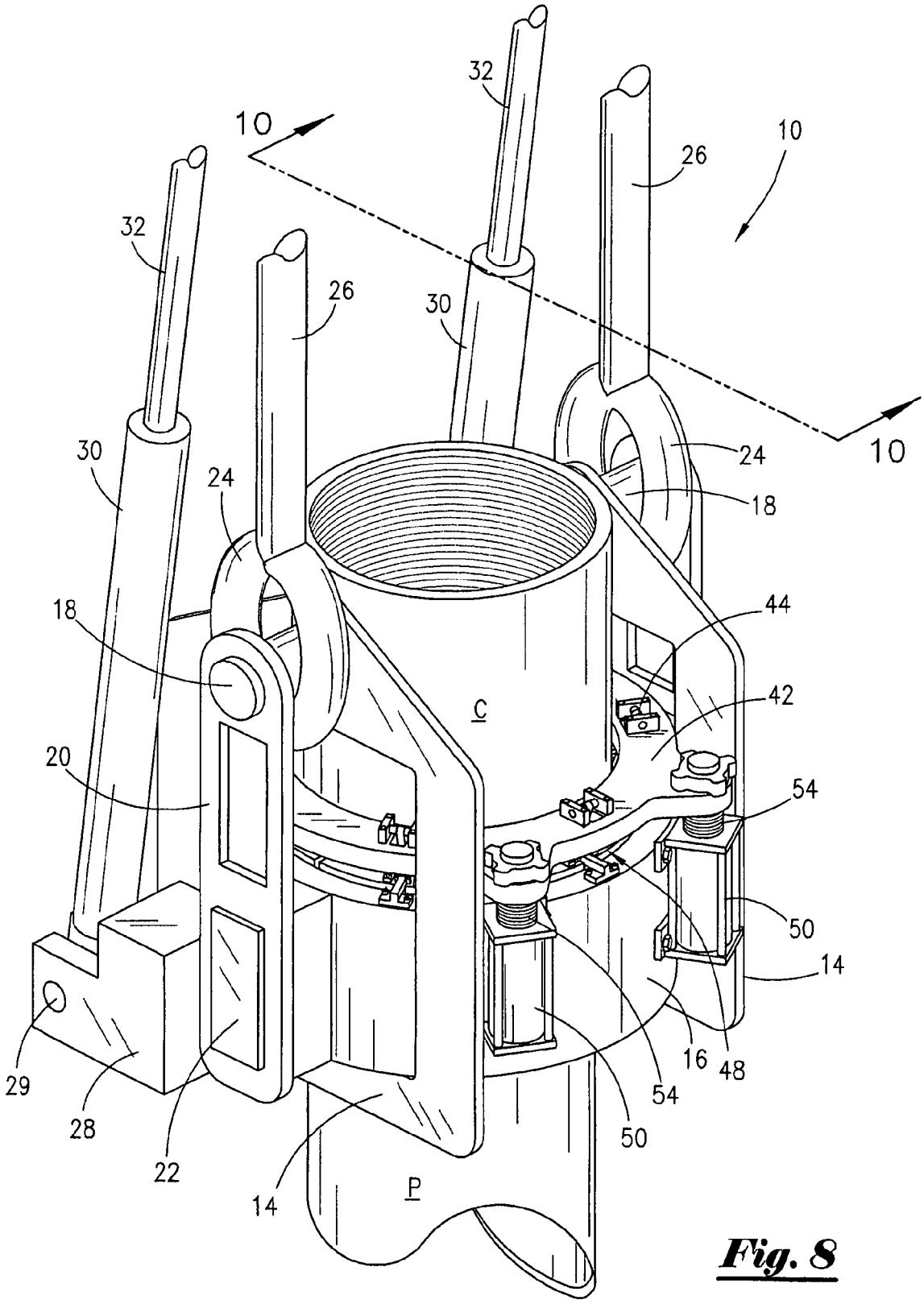
FIG. 8 is a perspective view of the elevator of the elevator of FIG. 1 with the elevator in an upright and centered position supporting a joint of pipe.

As shown in FIG. 7 and FIG. 8, retraction of the piston rods (32) into the cylinders (30) will rotate the elevator (10) and the body ring (16) about the axis of the hanger pins (18). It is expected that at least 90 degrees of rotation can be achieved with proper arrangement of the cylinders (30), cylinder rods (32), and hanger clamps (34). This rotation will allow the body ring (16) of the elevator (10) to be matched with an incoming pipe P having a collar C whether the incoming pipe P is presented on a skate or on slings through the "Vee Door" of a derrick. Extension of the cylinder rods (32) will allow the elevator (10) and its body ring (16) to be returned to its upright position.

It can be seen that other methods and means to rotate the elevator (10) about the axis of the hanger pins (18) might be utilized. For example, cables, not shown, may be attached to the body ring (16) or the frame plates (14). Extension and retraction of the cables would serve to rotate the elevator (10) about the hanger pins (18). The hydraulic cylinders (30), the brackets (28), and the hanger rod clamps (34) shown in the drawings provide merely one embodiment of elevator rotation means.

Figure 9:
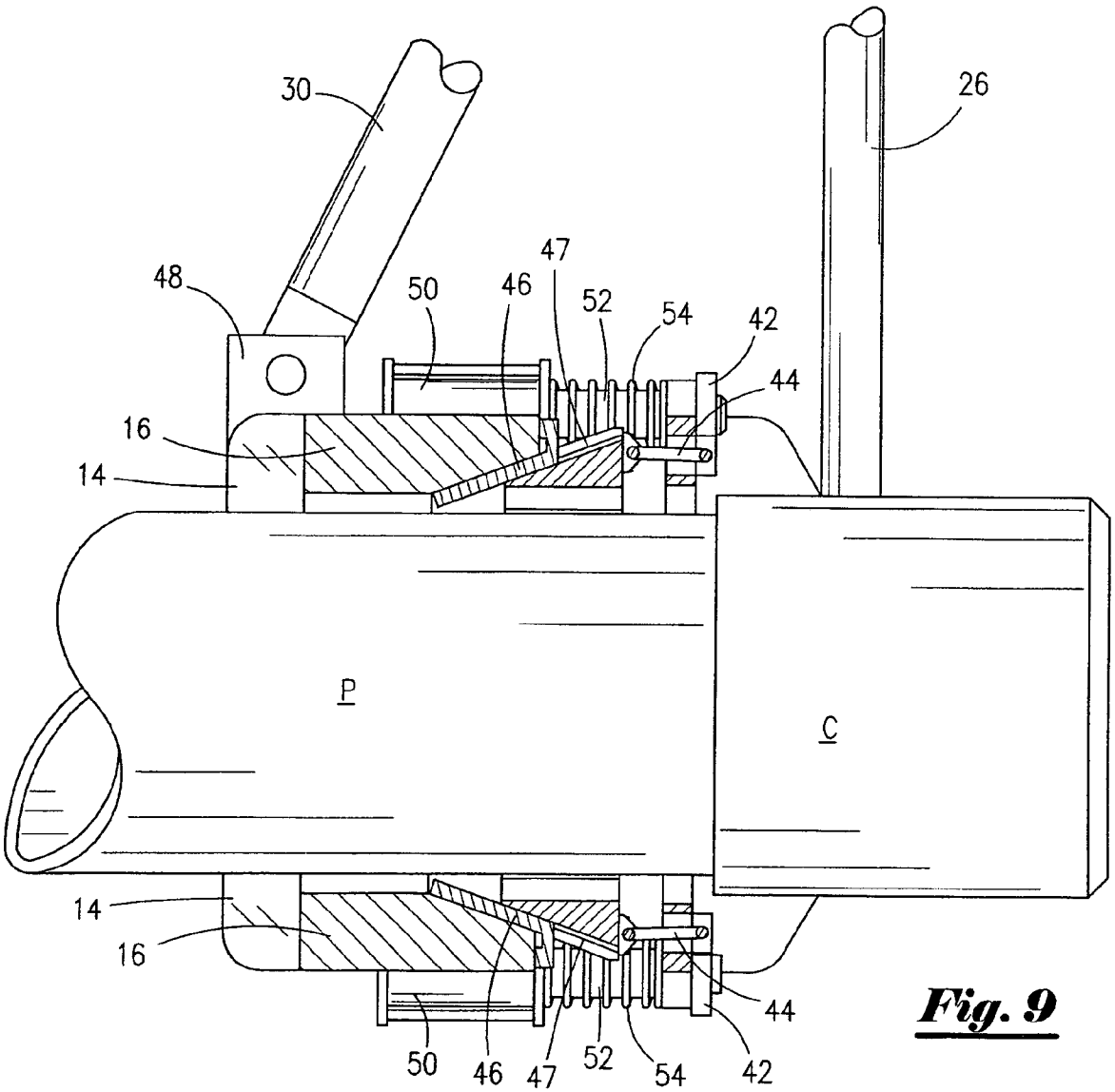
FIG. 9 is a side cross-sectional view of the elevator shown in FIG. 7.
Figure 10:
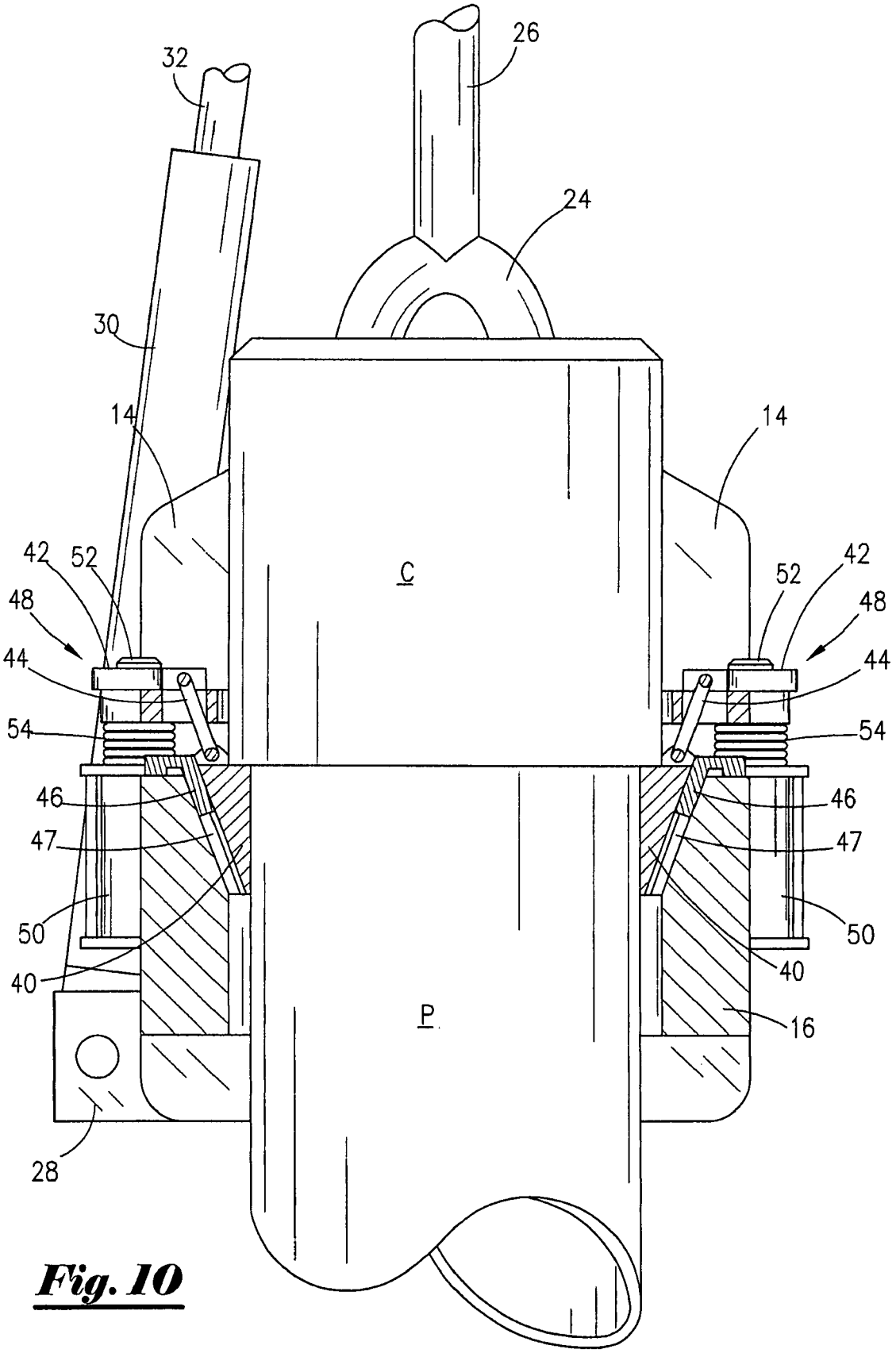
FIG. 10 is a side cross-sectional view of the elevator shown in FIG. 8.
Figure 11:
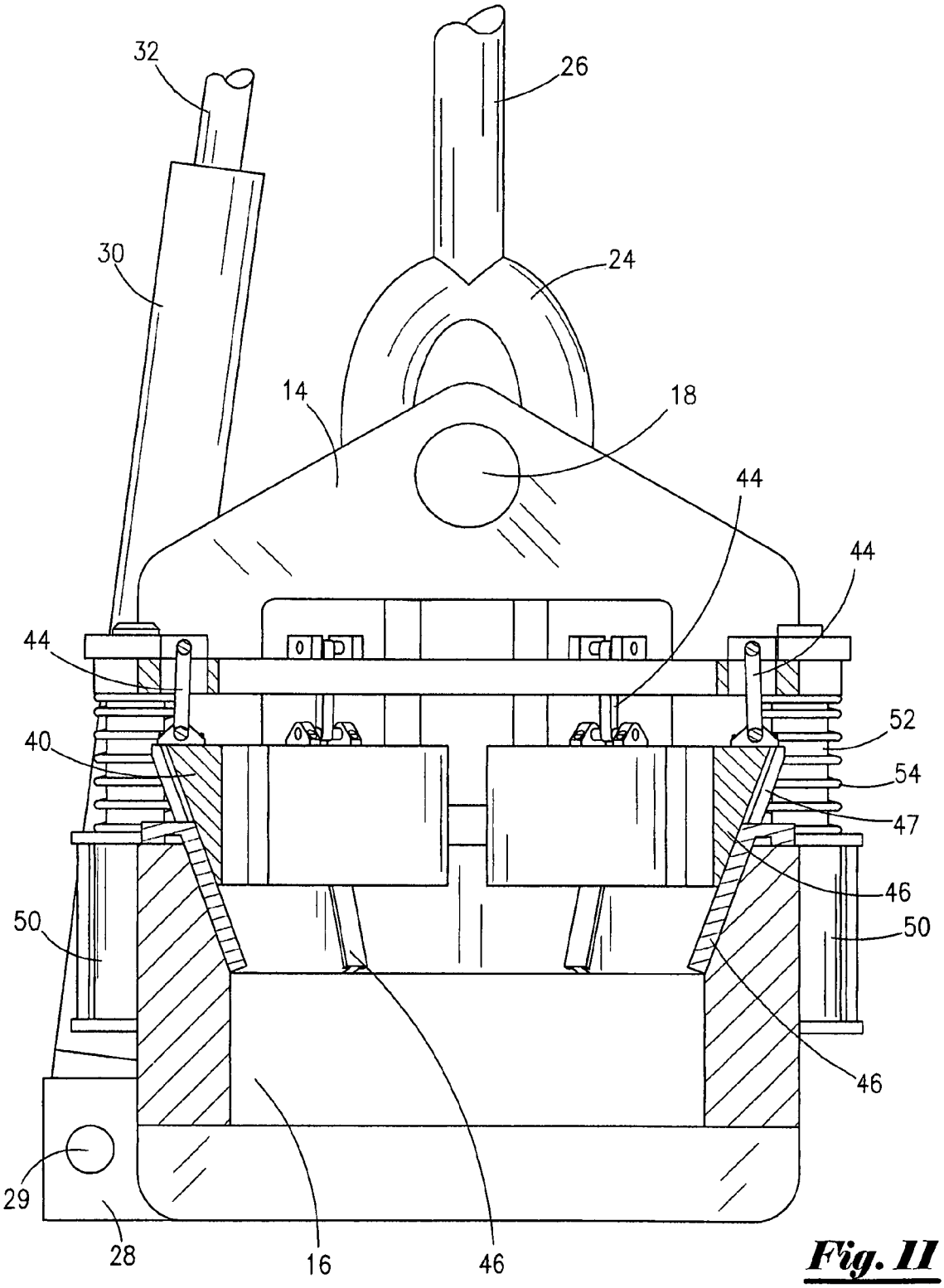
FIG. 11 is a side cross-sectional view of the elevator of FIG. 1 with the timing ring and shoes in a raised position.

The operation of the elevator is as shown in FIGS. 8, 9, and 10. In operation, the piston rods (32) of the cylinders (30) are retracted to rotate the elevator (10) on the hanger pins (18) to receive an incoming pipe P having a collar C within the body ring (16) as shown in FIG. 9. The timing ring (42) and thus the movable shoes (40) are then lowered by the cylinders (50) to a point where the timing ring (42) comes in contact the springs (54) around the cylinder rods (52) and where the shoes (40) are positioned around and below the collar C of pipe P. The shoe assembly (48) is configured to take-up the clearance between the pipe P and the body ring (16) of the elevator (10) and to keep the pipe P centralized within the body ring (16).

The cylinders (50) are configured so that at the point where the timing ring (42) comes into contact with the cylinder rod springs (54), further powered downward movement of the timing ring (42) and shoes (40) will cease. The timing ring (42) is then supported by the rod springs (54) with the shoes (40) of the shoe assembly (48) in a position slightly up from their fully down position.

Extension of the piston rods (32) of the cylinders (30) will rotate the elevator (10) on the hanger pins (18) to an upright position as shown in FIG. 8 and FIG. 10. In the upright position shown, the base of the collar C of the pipe P will contact the upper surface of the shoes (40) as the pipe P is supported by the shoe assembly (48). The weight of the pipe P on the shoes (40) from the collar C will move the shoes (40) downward against the resistance of the rod springs (54) and thus radially inward toward the pipe P until the shoes (40) contact the circumference of the pipe P below the collar C.

When the pipe P is contacted upon radial inward movement of the shoes (40), no further travel of the shoes (40) is possible and the pipe P is then virtually surrounded by the shoes (40) with the collar C supported around its periphery by the elevator shoe assembly (48). Because the pipe P is surrounded and supported for virtually 360 degrees with its collar C bearing on the shoes (40) and with the shoes (40) bearing on the exterior surface of the pipe P, the elevator (10) can safely support the pipe P regardless of the bevel configuration at the base of the pipe collar C.

Once the pipe P has been stabbed into the collar at the top of a preceding pipe in the pipe string which is being held in place by a spider or by other means, the elevator (10) may be lowered slightly to place the weight of the pipe P on the preceding pipe. This permits the time ring (42) and thus the shoes (40) to move upward by resistance from the cylinder rod springs (54).

The upward movement of the timing ring (42) induced by the compression rod springs (54) will cause the shoes (40) to move slightly radially away from the circumference surface of the pipe P. Thus, the slightly downward movement of the elevator (10) will provide clearance between the shoes (40) and the circumference surface of pipe P and thereby allow the pipe P to be rotated freely without drag or resistance from the shoes (40) as the pipe P is added to the pipe string during make-up. Because the shoes (40) are still positioned around and below the collar C of pipe P, the connection of pipe P to the pipe string may be made while the pipe P is still under control of the elevator (10). This will provide a safeguard from dropping or loosing pipe P as it is added to the pipe string during the make-up.

LIST OF COMPONENTS

| | |
|---|---|
| Elevator (10) | Frame (12) |
| Frame plates (14). | Ring-shaped elevator body (16) |
| Hanger pins (18) | Hanger plate (20 |
| Body flange segments (22) | Bails (24) |
| Hanger rods (26) | Cylinder brackets (28) |
| Bracket pins (29) | Hydraulic cylinders (30) |
| Piston rods (32) | Hanger rod clamps (34) |
| Shoes (40) | Timing ring (42) |
| Pin and link assemblies (44) | T's or keys (46) |
| T-slots or key slots (47) | Shoe assembly (48) |
| Hydraulic cylinders (50) | Cylinder rod (52) |
| Rod compression springs (54) | Pipe (P) |
| Collar (C) | |

It is thought that the elevator described herein and many of its intended advantages will be understood from the foregoing description. It is also thought that various changes in form, construction, and arrangement of the parts of the elevator may be made without departing from the spirit and scope of the invention described herein. The form herein described is intended to be merely illustrative of the preferred embodiment of the invention.

What is claimed is:

1. An elevator comprising:

(a) a frame;

(b) a body mounted to said frame, said body having an inwardly tapered interior surface, said body being configured to receive a length of pipe wherein one end said pipe has an outwardly protruding collar around its periphery;

(c) first and second elongated hangers pivotally mounted to said frame;

(d) a plurality of shoes mounted within said body, said shoes being poweredly positionable upward and downward within said body along a desired range of upward and downward movement along said inwardly tapered interior surface of said body and thereby positionable radially inward and outward entirely within said interior surface of said body below and around said collar of said length of pipe;

(e) means for providing a desired range of powered upward and downward movement of said shoes entirely within said body;

(g) means for biasing said shoes upward at the downward end of said powered range of upward and downward movement of said shoes within said body and whereby further powered downward movement of said shoes will cease and said shoes will be positioned around said pipe below said collar; and (h) whereby the weight of said pipe on said pipe collar on said shoes against biasing means will move said shoes against said periphery of said pipe under said pipe collar.

2. The elevator as recited in claim 1 wherein said shoes are curvilinearly arrayed around the interior of said body.

3. The elevator as recited in claim 2 wherein:

a) said means for providing a desired range of powered upward and downward movement of said shoes entirely within said body includes at least one shoe lift cylinder having an extendable and retractable piston rod; and (b) said means for biasing said shoes upward at the downward end of said powered range of upward and downward movement includes compression springs mounted around said extendable and retractable piston rod.

4. The elevator as recited in claim 3 further comprising:

(c) means for rotating said frame and thereby said body on said pivotally mounted hangers.

5. An elevator comprising:

(a) a frame;

(b) a body mounted to said frame, said body being configured to receive a length of pipe wherein one end said pipe has an outwardly protruding collar around its periphery;

(c) first and second elongated hangers, each said hanger having a bail at one end;

(d) a plurality of shoes mounted within said body, wherein said body has an inwardly tapered surface for supporting said shoes and wherein said shoes are curvilinearly arrayed around the interior of said body, said shoes being poweredly positionable upward and downward within said body along a desired range of upward and downward movement, and thereby positionable radially inward and outward within said body below and around said collar of said length of pipe;

(e) means for biasing said shoes upward at the downward end of said range of upward and downward movement whereby the weight of said pipe against said biasing means will move said shoes against said periphery of said pipe;

(f) first and second hanger pins mounted on said frame, said first hanger pin corresponding with said bail of said first elongated hanger and said second hanger pin corresponding with said bail of said second elongated hanger whereby said frame is pivotally mounted by said bails on said hanger pins; and (g) cylinders having retractable and extendable piston rods whereby extension and retraction of said piston rods will rotate said frame and thereby said body on said bails of said elongated hangers.

6. The elevator as recited in claim 5 wherein:

(a) shoe lift cylinders with extendable and retractable piston rods are used to poweredly position said shoes upward and downward within said body; and (b) said means for biasing said shoes upward at the downward end of said range of upward and downward movement includes compression springs mounted on said piston rods of said shoe lift cylinders.

7. The elevator as recited in claim 6, further comprising:

(a) a timing ring mounted to said piston rods of said shoe lift cylinders at a point above said body; and (b) a plurality of pin and link assemblies attached to said timing ring and said shoes.

8. An elevator comprising:

(a) a frame;

(b) a ring-shaped body mounted to said frame, said ring-shaped body having a top, a bottom, and an inwardly tapered interior surface, said ring-shaped body being configured to receive a length of pipe wherein one end of said pipe has a collar with an outwardly protruding shoulder around the periphery of said pipe;

(c) a timing ring, said timing ring being selectively positionable upward and downward from the top of said ring-shaped body;

(d) a plurality of shoes mounted to said timing ring, said shoes being curvilinearly arrayed around said interior surface of said ring-shaped body;

(e) a plurality of timing ring cylinders with extendable and retractable piston rods for powered reciprocal movement of said timing ring upward and downward with respect to said top of said ring-shaped body over a desired range, and thereby reciprocal movement of said shoes entirely within said interior of said ring-shaped body radially inward and outward around said length of pipe below said pipe collar; and (f) a compression spring mounted around each of said piston rods of said timing ring cylinders, said timing ring cylinders configured so that at the point where said timing ring comes into contact with said cylinder rod springs further powered downward movement of said timing ring and shoes will cease with said compression spring providing an upward bias to said timing ring at the end of said powered downward range of movement of said timing ring.

9. An elevator comprising:

(a) a frame;

(b) a ring-shaped body mounted to said frame, said ring-shaped body having a top, a bottom, and an inwardly tapered interior surface, said ring-shaped body being configured to receive a length of pipe wherein one end of said pipe has a collar with an outwardly protruding shoulder around the periphery of said pipe;

(c) a timing ring, said timing ring being selectively positionable upward and downward from the top of said ring-shaped body;

(d) a plurality of shoes mounted to said timing ring, said shoes being curvilinearly arrayed around said interior surface of said ring-shaped body;

(e) a plurality of timing ring cylinders with extendable and retractable piston rods for powered reciprocal movement of said timing ring upward and downward with respect to said top of said ring-shaped body over a desired range, and thereby reciprocal movement of said shoes within said interior of said ring-shaped body radially inward and outward around said length of pipe below said pipe collar;

(f) a compression spring mounted around each of said piston rods of said timing ring cylinders, said compression spring providing an upward bias to said timing ring at the end of said powered downward range of movement of said timing ring;

(g) at least one hanger pin mounted to said frame, said hanger pin having an axis extending parallel to said top surface of said ring-shaped body;

(h) at least one elongated hanger rod; said hanger rod having a bail, said hanger rod bail being pivotally mounted on said hanger pin; and (i) at least one hanger cylinder with an extendable and retractable piston rod, said hanger cylinder being pivotally mounted between said frame and said elongated hanger rod.

10. The elevator as recited in claim 9, wherein the position of said shoes within said interior of said ring-shaped body may be configured so that said pipe collar will bear on said shoes to compress said upwardly biased compression springs around said piston rods of said timing ring cylinders for further movement of said shoes downward and radially inward under said shoulder of said pipe collar and against the periphery of said pipe due to the weight of said pipe.

11. The elevator as recited in claim 10 wherein said shoes are mounted to said timing ring by an array of pin and link assemblies.

12. The elevator as recited in claim 11 further comprising means for extending and retracting said piston rod of said hanger cylinder.

13. The elevator as recited in claim 12 wherein extension and retraction of said piston rod of said hanger cylinder and said piston rods of said timing ring cylinders are remotely controlled.

14. An elevator comprising:

(a) a frame;

(b) a ring-shaped body mounted to said frame, said ring-shaped body having a top, a bottom, and an inwardly tapered interior surface, said ring-shaped body being configured to receive a length of pipe wherein one end said pipe has a collar having an outwardly protruding shoulder around the periphery of said pipe;

(c) a timing ring, said timing ring being selectively positionable upward and downward from the top of said ring-shaped body;

(d) a plurality of shoes mounted to said timing ring, said shoes being curvilinearly arrayed around said interior surface of said ring-shaped body;

(e) a plurality of timing ring cylinders with extendable and retractable piston rods for powered reciprocal movement of said timing ring upward and downward with respect to said top of said ring-shaped body over a desired range, and thereby powered reciprocal movement of said shoes within said interior of said ring-shaped body radially inward and outward around said length of pipe below said shoulder of said pipe collar;

(f) a compression spring mounted around each of said piston rods of said timing ring cylinders, said compression spring providing an upward bias to said timing ring at the end of said powered downward range of movement of said timing ring, and wherein the position of said shoes within said interior of said ring-shaped body is configured so that said pipe collar will bear on said shoes to compress said upwardly biased compression springs on said piston rods of said timing ring cylinders for further movement of said shoes downward and radially inward under said shoulder of said pipe collar and against the periphery of said pipe due to the weight of said pipe;

(g) a pair of opposing hanger pins mounted to said frame, said hanger pins having an axis extending parallel to said top surface of said ring-shaped body;

(h) a pair of elongated hanger rods attached to a hoist, each of said hanger rods having a bail, said bail of each said hanger rod being pivotally mounted on one of said opposing hanger pins; and (i) at least two hanger cylinders, each hanger cylinder having an extendable and retractable piston rod, each said hanger cylinder being pivotally mounted on said frame with its said piston rod pivotally mounted on one of said elongated hanger rods.

15. The elevator of claim 14 further comprising, controls for retracting and extending said piston rods of said timing ring cylinders, where said controls are configured so that at the point where said timing ring comes into contact with said compression springs mounted around said piston rods said powered downward movement of said timing ring will cease.

16. A method to make up and break out a casing string in a well bore comprising:

(a) providing a hoist for supporting an elevator;

(b) providing an elevator, said elevator having a:

i) frame;

ii) a body mounted to said frame, said body having an inwardly tapered interior surface, said body being configured to receive a length of pipe wherein one end said pipe has an outwardly protruding collar around its periphery;

iii) first and second elongated hangers pivotally mounted to said frame;

(iv) a plurality of shoes mounted within said body, said shoes being poweredly positionable upward and downward within said body along a desired range of upward and downward movement along said inwardly tapered interior surface of said body and thereby positionable radially inward and outward entirely within said interior surface of said body below and around said collar of said length of pipe;

(v) means for providing a desired range of powered upward and downward movement of said shoes within said body;

(vi) means for biasing said shoes upward at the downward end of said powered range of upward and downward movement of said shoes within said body whereby further powered downward movement of said shoes will cease and said shoes will be positioned around said pipe below said collar, and (vii) whereby the weight of said pipe on said pipe collar on said shoes against biasing means will move said shoes against said periphery of said pipe under said pipe collar;

(c) pivotally mounting said elevator on said hoist, whereby said elevator may be pivoted to a desired position to receive a length of pipe within said elevator body;

(d) pivoting said elevator to a desired position;

(e) inserting a length of pipe in said body of said elevator;

(f) powering said poweredly positionable shoes downward to the bottom of said poweredly positionable range of downward movement and thereby moving said slips radially inward around and below said collar of said length of pipe;

(g) pivoting said elevator to a desired position whereby the weight of said length of pipe against said biasing means will move said shoes against said periphery of said length of pipe below said collar of said length of pipe;

(h) stabbing said length of pipe on the collar of a preceding length of pipe;

(i) lowering the elevator whereby the weight of said length of pipe against said biasing means is relieved to move said shoes away from the periphery of said length of pipe while said shoes remain below and around said collar; and (j) rotating said length of pipe to make up said length of pipe with said preceding pipe in said well bore.

17. The method as recited in claim 16 wherein the step of providing, an elevator having a body includes:

(a) providing a ring-shaped body mounted to said frame, said ring-shaped body having a top, a bottom, and an inwardly tapered interior surface;

(b) providing a timing ring, said timing ring being selectively positionable upward and downward from the top of said ring-shaped body; and (c) wherein said shoes are curvilinearly arrayed around said interior surface of said ring-shaped body.

18. The method as recited in claim 17 wherein the step of providing an elevator having a body includes:

(a) selectively positioning said timing ring with a plurality of timing ring cylinders having extendable and retractable piston rods for powered reciprocal movement of said timing ring upward and downward with respect to said top of said ring-shaped body over a desired powered range; and (b) providing compression springs mounted on each of said piston rods of said timing ring cylinders as said means for biasing said shoes upward at the downward end of said range of upward and downward movement.

19. The method as recited in claim 18 further comprising the step of (a) providing remote controls for said timing ring cylinders; and (b) configuring said timing ring cylinders so that at the point where said timing ring comes into contact with said compression springs mounted around said piston rods powered downward movement of said timing ring will cease.

20. An elevator comprising:

(a) a frame;

(b) a ring shaped body mounted to said frame, said body having an upward end and a downward end and an interior surface inwardly tapered from said upward end to said downward end, said body being configured to receive a length of pipe wherein one end said pipe has an outwardly protruding collar around its periphery;

(c) a plurality of shoes mounted around said interior surface of said body, said shoes being poweredly positionable upward and downward along said inwardly tapered surface along a desired range of upward and downward movement and thereby positionable radially inward and outward along a desired range of inward and outward movement within said body below and around said outwardly protruding collar of said length of pipe whereby said pipe collar will rest upon said shoes; and (d) means for biasing said shoes upward at the end of said range of desired powered downward movement of said shoes whereby the weight of said pipe on said collar against said shoes will move said shoes downward and inward under said collar against said pipe.

21. The elevator as recited in claim 20, further comprising:

(a) at least one hanger pivotally mounted to said frame; and (b) means for pivoting said frame, and thereby said body, on said hanger.

* * * * *